US011118583B2

(12) United States Patent
Watanabe et al.

(10) Patent No.: US 11,118,583 B2
(45) Date of Patent: Sep. 14, 2021

(54) SCROLL FLUID MACHINE WITH CONCAVE AND CONVEX PORTIONS IN THE SPIRAL LAPS

(71) Applicant: Hitachi Industrial Equipment Systems Co., Ltd., Tokyo (JP)

(72) Inventors: Sho Watanabe, Tokyo (JP); Susumu Sakamoto, Tokyo (JP); Yoshio Kobayashi, Tokyo (JP); Kiminori Iwano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 533 days.

(21) Appl. No.: 15/578,093

(22) PCT Filed: Jun. 3, 2015

(86) PCT No.: PCT/JP2015/065974

§ 371 (c)(1),
(2) Date: Mar. 1, 2018

(87) PCT Pub. No.: WO2016/194156

PCT Pub. Date: Dec. 8, 2016

(65) Prior Publication Data

US 2018/0202441 A1 Jul. 19, 2018

(51) Int. Cl.
*F04C 18/02* (2006.01)

(52) U.S. Cl.
CPC ..... *F04C 18/0269* (2013.01); *F04C 18/02* (2013.01); *F04C 18/0215* (2013.01)

(58) Field of Classification Search
CPC ..... F04C 18/0269
See application file for complete search history.

(56) References Cited

U.S. PATENT DOCUMENTS 5,591,022 A 1/1997 Protos
9,951,773 B2 * 4/2018 Choi ..... F04C 18/0269
(Continued)

FOREIGN PATENT DOCUMENTS

JP 8-4669 A 1/1996
JP 2004-138056 A 5/2004
JP 2006-17013 A 1/2006
(Continued)

OTHER PUBLICATIONS

Korean-language Office Action issued in counterpart Korean Application No. 1020177037189 dated Nov. 20, 2018 with English translation (12 pages).
(Continued)

*Primary Examiner* — Mary Davis
(74) *Attorney, Agent, or Firm* — Crowell & Moring LLP

(57) ABSTRACT

The present invention makes a lap clearance between a fixed scroll and an turning scroll as small as possible to suppress leakage of compressed fluid from a compression chamber in a compression operation, thereby improving a compression efficiency. Provided is a scroll-type fluid machine characterized by comprising: a fixed scroll having a scroll lap portion; and an orbiting scroll that is provided to face the fixed scroll and that has a scroll lap portion turning so as to form a plurality of compression chambers in a clearance relative to the lap portion of the fixed scroll, wherein the lap portion of at least one of the fixed scroll and the turning scroll is provided with, in a predetermined region, a recessed portion on one lateral surface thereof and a protruding portion on the other lateral surface thereof.

10 Claims, 7 Drawing Sheets

X-X CROSS-SECTION

(56) References Cited

U.S. PATENT DOCUMENTS

| | | | |
|---|---|---|---|
| 2004/0062671 | A1 | 4/2004 | Suefuji et al. |
| 2008/0159894 | A1 | 7/2008 | Kanemoto |

FOREIGN PATENT DOCUMENTS

| | | | |
|---|---|---|---|
| JP | 2010-248995 | A | 11/2010 |
| JP | 4988805 | B2 | 8/2012 |
| JP | 2015-71947 | A | 4/2015 |
| WO | WO 2014/124503 | A2 | 8/2014 |
| WO | WO 2014/124503 | A3 | 8/2014 |

OTHER PUBLICATIONS

Chinese-language Office Action issued in counterpart Chinese Application No. 201580081251.X dated May 7, 2019 with English translation (15 pages).
International Search Report (PCT/ISA/210) issued in PCT Application No. PCT/JP2015/065974 dated Sep. 8, 2015 with English translation (Four (4) pages).
Japanese-language Written Opinion (PCT/ISA/237) issued in PCT Application No. PCT/JP2015/065974 dated Sep. 8, 2015 (Six (6) pages).
Extended European Search Report issued in counterpart European Application No. 15894189.8 dated Oct. 2, 2018 (seven (7) pages).
Hindi language Office Action issued in Indian Application No. 201717046099 dated Feb. 28, 2020 with English translation (seven (7) pages).
Korean-language Office Action issued in Korean Application No. 10-2020-7028959 dated Oct. 22, 2020 with English translation (12 pages).

* cited by examiner

SCROLL FLUID MACHINE WITH CONCAVE AND CONVEX PORTIONS IN THE SPIRAL LAPS

TECHNICAL FIELD

The present invention relates to a scroll-type fluid machine which is preferably used as a vacuum pump, a compressor, and the like such as for air or coolant, for example.

BACKGROUND ART

Patent Literature 1 describes a configuration in which a portion of a lap part of a fixed scroll or an orbiting scroll where the temperature increase on the tooth tip side is greater than the temperature increase on the tooth bottom side while in a compression operation has a clearance larger than that of a portion of the lap part of the fixed scroll or the orbiting scroll where the temperature increase on the tooth bottom side is greater than the temperature increase on the tooth tip side in a state where the lap parts of the scrolls facing each other on the outer side in a radial direction are closest to each other.

CITATION LIST

Patent Literature

Patent Literature 1: JP4988805B

SUMMARY OF INVENTION

Technical Problem

A scroll-type fluid machine is intended to enhance compression efficiency and the like by reducing the lap clearance between a fixed scroll and an orbiting scroll as much as possible and suppressing leakage of compressed fluid from a compression chamber while in a compression operation. Here, compressed air, which has been compressed to have an increased temperature, heats the laps and the lap clearance changes due to thermal deformation. Because of the change in the lap clearance, there arises a possibility that the laps come into contact with each other in a region where the clearance decreases. Meanwhile, in a region where the clearance increases, compressed fluid leaks and the performance becomes worse.

The conventional art described above prevents the laps from coming into contact with each other due to thermal deformation by providing a configuration in which a portion of a lap part where the temperature increase on the tooth tip side is greater than the temperature increase on the tooth bottom side while in a compression operation has a clearance larger than that of a portion where the temperature increase on the tooth bottom side is greater than the temperature increase on the tooth tip side in a state where the lap parts of the scrolls facing each other on the outer side in a radial direction are closest to each other.

On the other hand, however, no mention is made on a portion where the lap clearance increases due to thermal deformation, which poses a problem that the leakage quality of the compressed fluid worsens.

Solution to Problem

For example, a configuration described in the scope of the claims is chosen for the purpose of solving the problem described above. The present invention includes more than one means for solving the problem described above, and one example thereof is to provide a scroll-type fluid machine which includes: a fixed scroll including a spiral-shaped lap part; and an orbiting scroll which is provided facing the fixed scroll and which includes a spiral-shaped lap part orbiting to form a plurality of compression chambers between the lap part of the fixed scroll and the lap part of the orbiting scroll, in which the lap part of at least one of the fixed scroll and the orbiting scroll includes a concave portion provided in one lateral surface in a predetermined region and includes a convex portion provided on the other lateral surface.

Advantageous Effects of Invention

The present invention makes it possible to achieve performance improvement while maintaining reliability even when the lap clearance changes due to thermal deformation.

DESCRIPTION OF EMBODIMENTS

Hereinafter, examples of the present invention are described based on FIGS. 1 to 8.

Figures 1A, 1B, 1C, 1D, 1E:
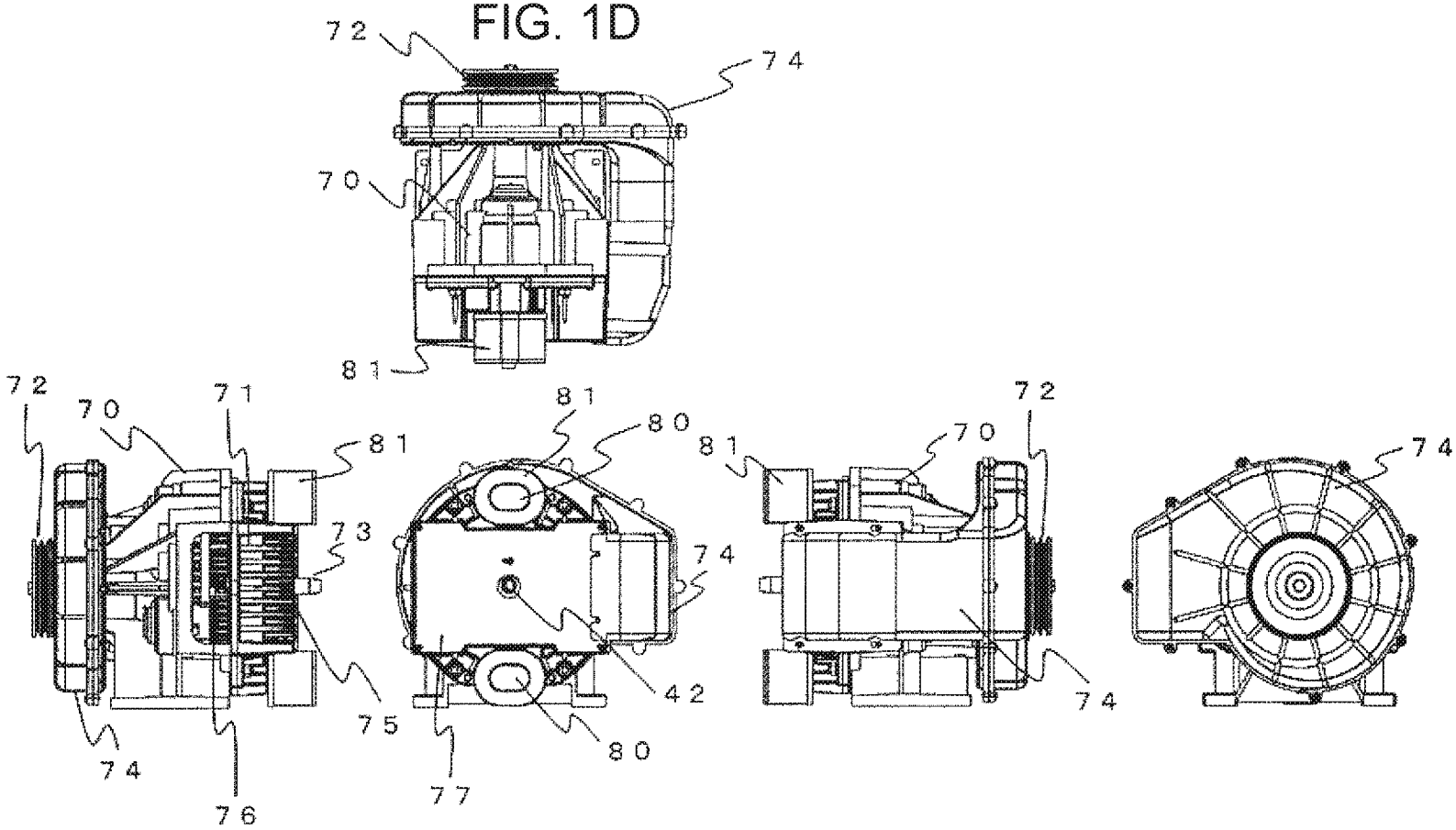
FIGS. 1A to 1E are external views of a scroll-type compressor main body of the present invention.

FIG. 1 gives external views of a scroll-type compressor main body, and: (A) is a front view; (B) is a right side view; (C) is a left side view; (D) is a plan view; and (E) is a back view. In FIG. 1, 70 is a casing which constitutes an external shell of the compressor main body and which is formed in the shape of a bottomed tube with one side in an axial direction closed and the other side in the axial direction opened. An orbiting scroll and the like to be described later are accommodated inside a tube portion of the casing 70. The compressor main body includes a fixed scroll as one scroll member provided and fixed to the open end side of the casing 70. Inside 71 are compression chambers each defined between the lap part of the fixed scroll and the lap part of the orbiting scroll. Each of the compression chambers is created by laying the lap part of the orbiting scroll over the lap part of the fixed scroll. 72 is a pulley, which is provided on one end of a drive shaft (not illustrated), which is connected via e.g. a belt to the output side of an electric motor (both are not illustrated) as a drive source, and which drives the drive shaft. The drive shaft is configured to rotate the orbiting scroll relative to the fixed scroll. Note that the configuration may be such that the compressor is a motor integrated type scroll-type air compressor which has the rotational shaft of the motor unitary with the drive shaft, thereby eliminating the necessity of the pulley 72 or the belt. Then, 80 is a suction port provided on the outer circumferential side of the fixed scroll. The suction port 80 suctions air from the outside via a suction filter 81. This air is continuously compressed inside each compression chamber along with the rotation of the orbiting scroll.

To be more specific, the orbiting scroll is driven through the drive shaft by the electric motor (not illustrated) and the like and rotates relative to the fixed scroll. Thus, out of the compression chambers, the compression chamber on the outer diameter side suctions air through the suction ports 80 of the fixed scroll, and this air is continuously compressed inside each compression chamber. Then, the compressed air is discharged to the outside through a discharge port 42 positioned at the center side from the compression chamber on the innermost diameter side. Then, 73 is a discharge pipe provided and connected to the discharge port 42 of the fixed scroll. The discharge pipe 73 constitutes a discharge flow path which establishes communication between a storage tank (not illustrated) and the discharge port 42. Additionally, 74 is a fan duct which guides cooling air, produced by the rotation of a cooling fan to be described later, to fixed cooling fins 75 of the fixed scroll and to rotational cooling fins 76 of the orbiting scroll. Moreover, 77 is a fin cover which covers the fixed cooling fins 75. The structure described above is the basic structure of a scroll-type compressor and is common to Examples 1 to 5 to be explained later.

Figure 2:
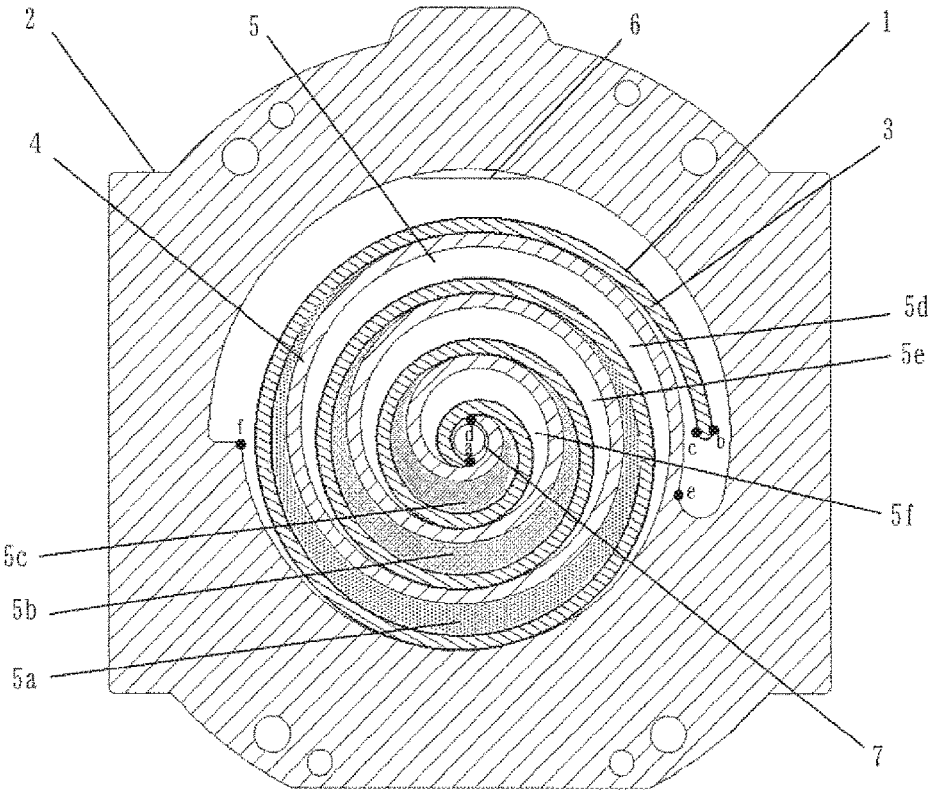
FIG. 2 is a cross-sectional view of a scroll-type compressor according to Example 1 of the present invention.

Next, FIG. 2 illustrates a cross-sectional view of a scroll portion of the scroll-type compressor of the present invention. An orbiting scroll 1 and a fixed scroll 2 are each erected in the shape of a spiral on a panel and are laid on each other. When the orbiting scroll 1 rotates, compression chambers 5, defined between a lap part 3 of the orbiting scroll 1 and a lap part 4 of the fixed scroll 2, continuously shrink. Thus, each of the compression chambers sequentially compresses air suctioned through a suction port 6 and discharges this compressed air from a discharge port 7 via the discharge port 42 toward an external air tank (not illustrated).

In the lap part 3 of the orbiting scroll 1, the region between a and b is referred to as an outer line and the region between a and c is referred to as an inner line. Similarly, in the lap part 4 of the fixed scroll 2, the region between d to e is referred to as an outer line and the region between d to f is referred to as an inner line. While the orbiting scroll 1 is moving due to the rotation, three compression chambers are formed at the moment of FIG. 2 between the inner line of the lap part 3 of the orbiting scroll 1 and the outer line of the lap part 4 of the fixed scroll 2. The three compression chambers are named a compression chamber Pa (5*a*), compression chamber Pb (5*b*), and compression chamber Pc (5*c*), in the order from the compression chamber 5 on the outer circumferential side. Similarly, three compression chambers are formed between the outer line of the lap part 3 of the orbiting scroll 1 and the inner line of the lap part 4 of the fixed scroll 2. The three compression chambers are named a compression chamber Pd (5*d*), compression chamber Pe (5*e*), and compression chamber Pf (5*f*), in the order from the compression chamber 5 on the outer circumferential side. The pressure of each of the compression chambers is high as approaching a discharge port 6. To be more specific, the order of pressure height is 5*c*>5*b*>5*a*, and similarly, 5*f*>5*e*>5*d*.

Figure 3:
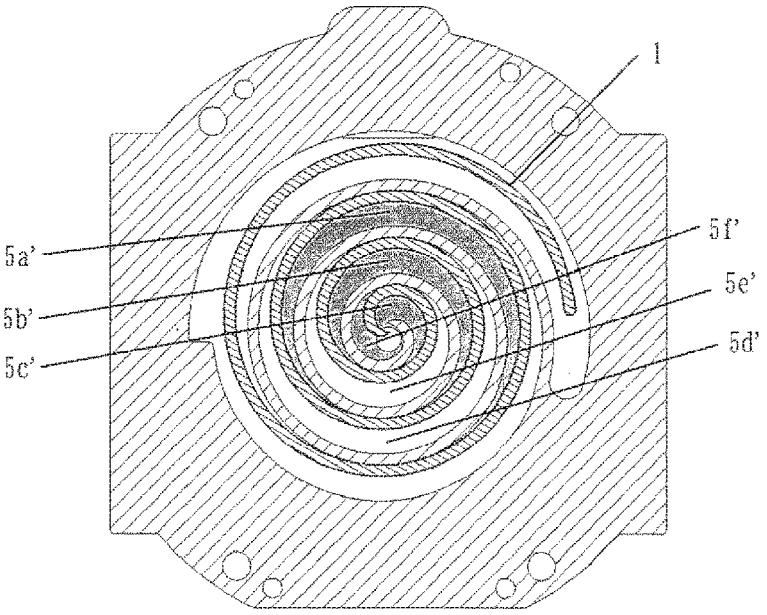
FIG. 3 is a cross-sectional view of the scroll-type compressor according to Example 1 of the present invention.

FIG. 3 illustrates a cross-sectional view of the scroll-type compressor after the orbiting scroll 1 moves half rotated from the state of FIG. 2. At the moment of FIG. 3, the compression chambers have half rotated and approached the discharge port 6. The compression chamber Pa (5*a*) changed to compression chamber Pa' (5*a*'), the compression chamber Pb (5*b*) to compression chamber Pb' (5*b*'), and the compression chamber Pc (5*c*) to compression chamber Pc' (5*c*'). Similarly, the compression chamber Pd (5*d*) changed to compression chamber Pd' (5*d*'), the compression chamber Pe (5*e*) to compression chamber Pe' (5*e*'), and the compression chamber Pf (5*f*) to compression chamber Pf' (5*f*'). Among these, the compression chamber Pc' (5*c*') and the compression chamber Pf' (5*f*') communicate with the discharge port 6 and discharge compressed air to the air tank (not illustrated).

Figure 4:
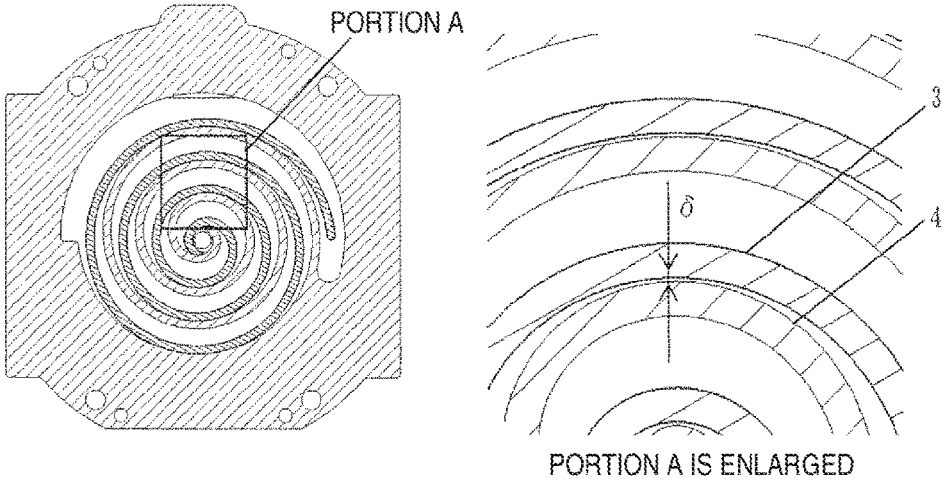
FIG. 4 is a cross-sectional view of the scroll-type compressor according to Example 1 of the present invention.

FIG. 4 illustrates the lap clearance. As illustrated in FIG. 4, the orbiting scroll 1 and the fixed scroll 2 forms a clearance δ (referred to as the lap clearance) as small as possible in a radial direction between the lap parts 3 and 4 in order to suppress leakage of compressed air from the compression chambers, enhancing efficiency and the like of an air compressor.

The compressed air is high in temperature and thus the orbiting scroll 1 and the fixed scroll 2 undergo thermal deformation. In addition, deformation takes place by the pressure of compressed air. Besides, the lap parts 3 and 4 deform similarly. Hence, if the lap clearance δ is small, there is a possibility that the lap parts 3 and 4 come into contact with each other when the lap parts 3 and 4 deform due to the influence of heat and the like of the compressed air.

Figure 5:
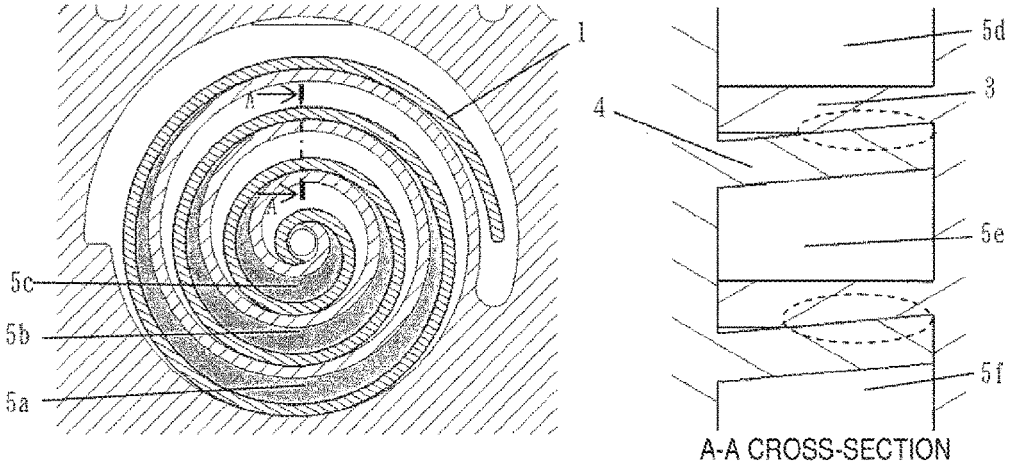
FIG. 5 is a cross-sectional view of the scroll-type compressor illustrating a problem of the present invention.
Figure 6:
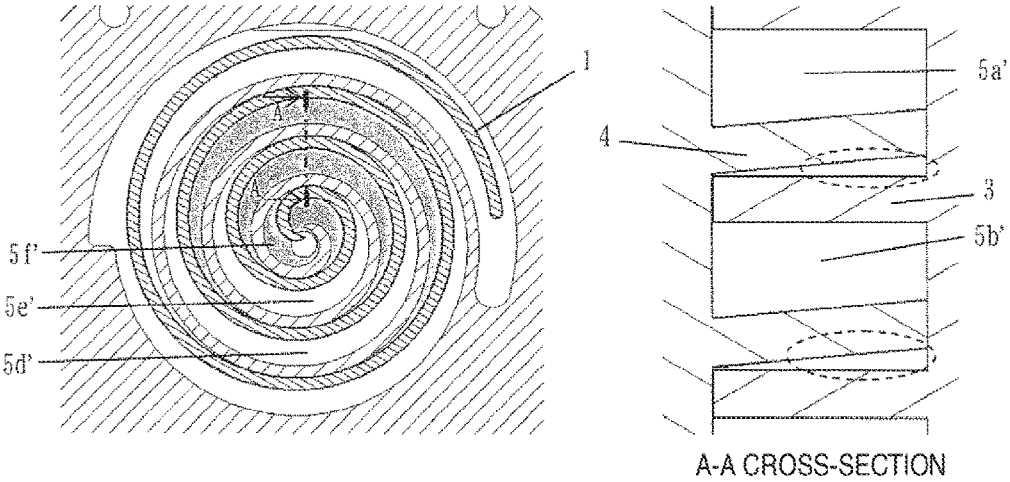
FIG. 6 is a cross-sectional view of the scroll-type compressor illustrating the problem of the present invention.

FIG. 5 and FIG. 6 each are a cross-sectional view of the scroll-type compressor illustrating the problem of the present invention. FIG. 5 illustrates compressor in operation in the case where the lap clearance δ is small. In the cross section A-A, which crosses the compression chamber Pc (5*c*) and the compression chamber Pb (5*b*), and the compression chamber Pb (5*b*) and the compression chamber Pa (5*a*), the lap part 3 is touched by the lap part 4 deformed due to the influence of heat and the like. In this case, the scroll-type compressor will break. On the other hand, a possible solution is to take a large lap clearance δ so that the lap part 3 and the lap part 4 do not come into contact with each other. In that case, compressed air flows out due to pressure difference through the lap clearance δ from the compression chamber Pc (5*c*) to the compression chamber Pb (5*b*) and from the compression chamber Pb (5*b*) to the compression chamber Pa (5*a*). As a result, efficiency as a compressor reduces.

FIG. 6 illustrates the moment in which the orbiting scroll 1 has moved half rotated from the state of FIG. 5. The cross-section A-A at the same position as that of FIG. 5 is illustrated. The cross-section A-A of FIG. 6 crosses the compression chamber Pf' (5*f*') and the compression chamber Pe' (5*e*'), and the compression chamber Pd' (5*d*') and the compression chamber Pe' (5*e*'). The lap part 4, which was deformed to lean against and touch the lap part 3 due to the influence of heat and the like at the moment of FIG. 5, has a shape away from the lap part 3 because of the deformation after the orbiting scroll 1 moves half rotated, thus producing a clearance. Compressed air flows out through this clearance due to pressure difference from the compression chamber Pf'

(5*f*') to the compression chamber Pe' (5*e*'), and from the compression chamber Pe' (5*e*') to the compression chamber Pd' (5*d*'). As a result, efficiency as a compressor reduces.

Patent Literature 1 (JP4988805B) described in the background art is configured such that in a portion where the lap clearance δ becomes small due to deformation, the thicknesses of the lap parts 3 and 4 are reduced so as to prevent contact with the lap part 3 and to keep the lap clearance δ small. On the other hand, in a portion where the lap clearance δ becomes large as illustrated in FIG. 6, the clearance still exists. As a result, efficiency as a compressor reduces.

Figure 7:
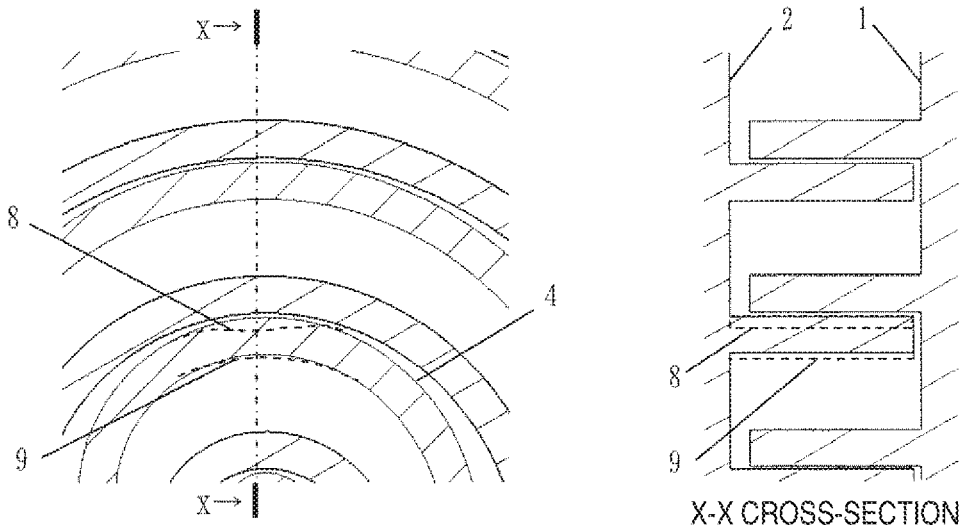
FIG. 7 is a cross-sectional view of a lap part according to Example 1 of the present invention.
Figure 8:
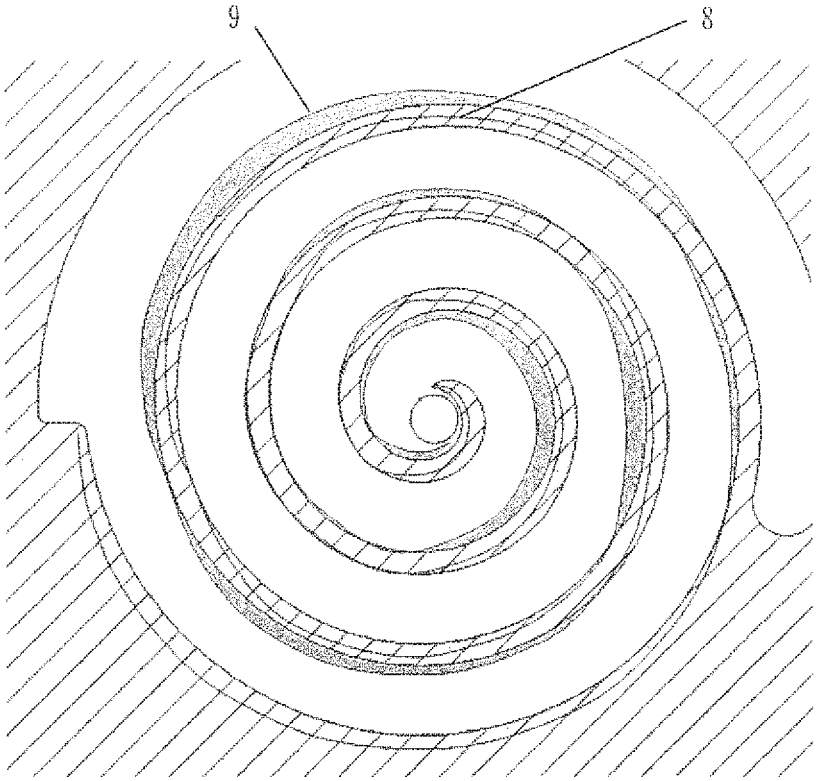
FIG. 8 is a cross-sectional view of a fixed scroll according to Example 1 of the present invention.
Figure 9:
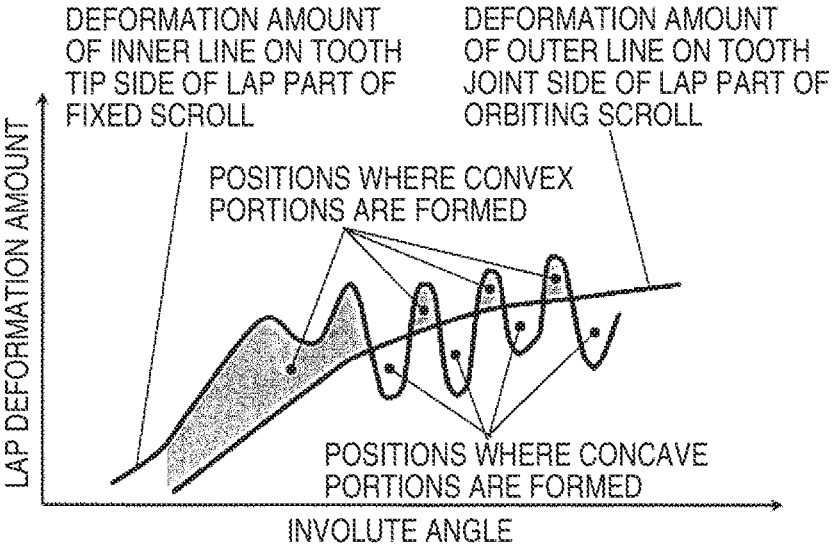
FIG. 9 is a graph of a lap deformation amount according to Example 1 of the present invention.

FIG. 7 illustrates the shape of the lap part 4 in the present example. In the present example, a concave portion 8 is provided in a lateral surface of the lap part 4 in a portion where the lap clearance becomes small due to the influence of heat and the like so as to prevent the lap parts 3 and 4 from coming into contact with (biting) each other, as illustrated in FIG. 7. On the other hand, a convex portion 9 is provided on a lateral surface opposite to that in which the concave portion 8 is provided in order to prevent the lap clearance from becoming large. If the convex portion 9 is provided, it is possible to prevent widening of the lap clearance and prevent leakage of the compressed air even after the deformation of the lap part 3 and the lap part 4. FIG. 8 illustrates a cross-sectional view of the lap part 4 of the fixed scroll 2 in the present example. In FIG. 7, the concave portion 8 and the convex portion 9 are only provided in a portion of the lap part 4 for the purpose of explanation. In the present example, however, the concave portion 8 and the convex portion 9 are provided on the entire circumference of the lap part 4, as illustrated in FIG. 8. In addition, although not illustrated, the concave portion 8 and the convex portion 9 may be provided on the entire circumference of the lap part 3 of the orbiting scroll 1 in the same way. FIG. 9 illustrates deformation amounts of the lap parts 3 and 4 while in operation of the compressor. The vertical axis represents the lap deformation amount, i.e. the magnitude of the deformation amount toward the outer side in the circumferential direction. The horizontal axis is the involute angle from the lap center portion. As illustrated in FIG. 9, the positions to provide the concave portion 8 and the convex portion 9 can be determined by comparing the deformation amounts of opposing lap part 3 and the lap part 4, for example by comparing the deformation amount of the inner line on the tooth tip side of the lap part 4 of the fixed scroll 2 and the deformation amount of the outer line on the tooth joint side of the lap part 3 of the opposing orbiting scroll 1. If comparison is made as in FIG. 9, the portions to provide the convex portion 9 and the concave portion 8 in the lap part 4 of the fixed scroll 2 are ones where the deformation amount of the inner line on the tooth tip side of the lap part 4 of the fixed scroll 2 is larger and smaller than the deformation amount of the outer line on the tooth joint side of the lap part 3 of orbiting scroll 1, respectively.

In addition, in the same manner, the positions to provide the convex portion and the concave portion are determined by comparing the deformation amount of the outer line on the tooth tip side of the lap part 4 of the fixed scroll 2 and the deformation amount of the inner line on the tooth joint side of the lap part 3 of the opposing orbiting scroll 1, although not illustrated. Moreover, the positions to provide the convex portion and the concave portion can be determined by comparing the deformation amounts of the inner line and the outer line on the tooth joint side of the lap part 4 of the fixed scroll 2 and the deformation amounts of the inner line and the outer line on the tooth tip side of the lap part 3 of the opposing orbiting scroll 1.

Additionally, the sizes of the convex portion and the concave portion can be adjusted depending on the deformation amount. For example, the convex portion is formed larger in a region where the difference between the deformation amount of the inner line on the tooth tip side of the lap part 4 of the fixed scroll 2 and the deformation amount of the outer line on the tooth joint side of the lap part 3 of the orbiting scroll 1 illustrated in FIG. 9 is larger compared to another region.

In FIG. 8, the convex portions and the concave portions are provided in the fixed scroll 2. However, the convex portions and the concave portions may be provided in the orbiting scroll 2 or in both the fixed scroll 2 and the orbiting scroll 1, based on the deformation amount illustrated in FIG. 9. The sizes of the concave portion 8 and the convex portion 9 in the present example are calculated in advance based on the amount of thermal deformation in operation and are formed by adjusting the amount cut during the cut processing as necessary. The concave portion 8 and the convex portion 9 are formed by increasing the amount cut when forming the concave portion 8 and by reducing the amount cut when forming the convex portion 9. On the other hand, the concave portion 8 and the convex portion 9 may be formed by coring by adjusting in advance the mold of material of the lap parts 3 and 4 without resorting to the cut processing, as a method of creating the concave portion 8 and the convex portion 9. Moreover, if a coating agent is applied on the lateral surfaces of the lap part 3, the lap part 4, or both of them, the concave portion 8 and the convex portion 9 may be created by adjusting the thickness of the coating agent.

Regarding the concave portion or the convex portion, one can consider that the concave portion is a portion processed in a direction to reduce the thickness of the lap part relative to a lap part in another region (toward the outer side in the radial direction for an inner line and toward the inner side in the radial direction for an outer line) and the convex portion is a portion processed in a direction to relatively increase the thickness (toward the inner side in the radial direction for an inner line and toward the outer side in the radial direction for an outer line). In addition, one may consider that the concave portion or the convex portion is a concave portion or a convex portion as a concavity and a convexity relative to the thickness and the involute curve being a reference for spiral scroll.

Figure 10:
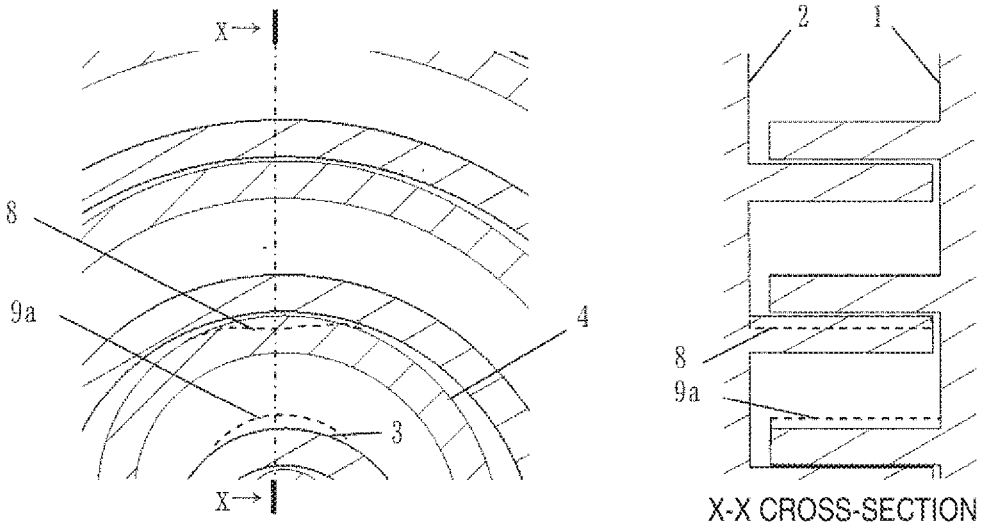
FIG. 10 is a cross-sectional view of a lap part according to Example 2 of the present invention.

Next, Example 2 is described using FIG. 10. FIG. 10 illustrates the shape of the lap part in the present example. In the same way as in Example 1, the concave portion 8 is provided in the lateral surface of the lap part 4 in a portion where the lap clearance becomes small due to the deformation of the lap so as to prevent the lap part 3 and the lap part 4 from coming into contact with each other. On the other hand, a convex portion 9*a* is provided on the lateral surface of the lap part 3 facing the lateral surface opposite to the lateral surface provided with the concave portion 8. The convex portion 9*a* is provided on the lateral surface facing the lateral surface opposite to the lateral surface provided with the concave portion 8, not on the lateral surface opposite to the lateral surface provided with the concave portion 8. As a result, a convex portion or a concave portion is provided on only one side of a lap part. This makes it possible to process a lap part with the side not provided with the convex portion or the concave portion as a reference, making it easy to check processing accuracy. Hence, productivity improves.

Figure 11:
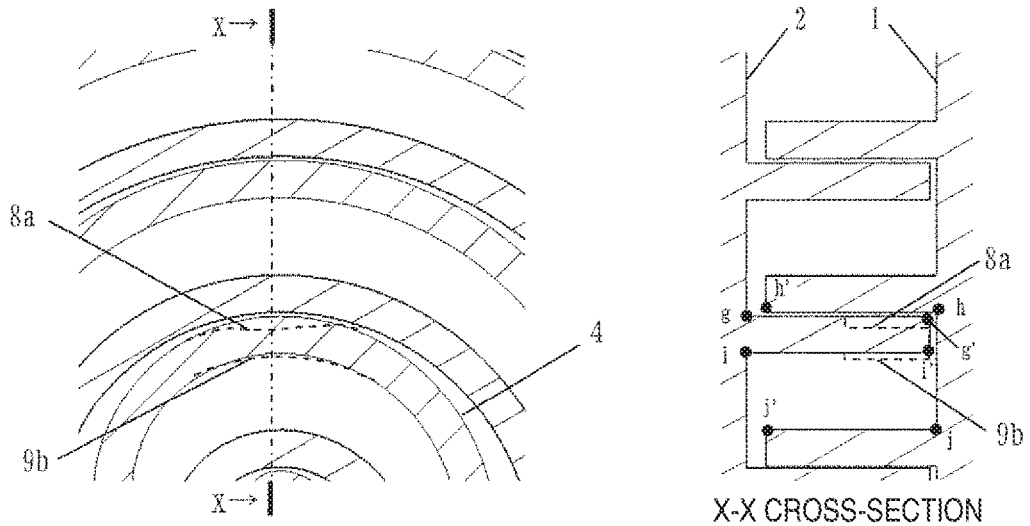
FIG. 11 is a cross-sectional view of a lap part according to Example 3 of the present invention.

Next, Example 3 is described using FIG. 11. FIG. 11 illustrates the shape of the lap part in the present example. In the same way as in Examples 1 and 2, a concave portion 8*a* is provided in the lateral surface of the lap part 4 in a portion where the lap clearance becomes small due to the deformation of the lap. The extension of the concave portion 8*a* is along only a portion of the tooth tip side in a direction (tooth height direction) from the tooth joint (g) toward the tooth tip (g') of the lap part 4. This configuration has an effect of reducing the extension of the concave portion 8*a* as necessarily small as possible in the case where the lap clearance becomes small between g' and h but the lap clearance does not change to a great extent between g and h' when the lap clearance is observed between the extension g-g' of the lap part 4 provided with the concave portion 8*a* and the extension h-h' of the lap part 3 opposite to the extension g-g', for example. If the extension of the concave portion 8*a* is made as necessarily small as possible, the lap clearance does not unnecessarily increases. Thus, the risk of leakage reduces and the performance improves.

Additionally, regarding a convex portion 9*b*, the convex portion 9*b* is provided only on the tooth tip (i') side in the portion i-i'. This makes it possible to appropriately prevent the lap clearance on the tooth tip (i') side from increasing also in the case where the lap clearance between i and j' on the tooth joint side becomes small or remain constant.

Figure 12:
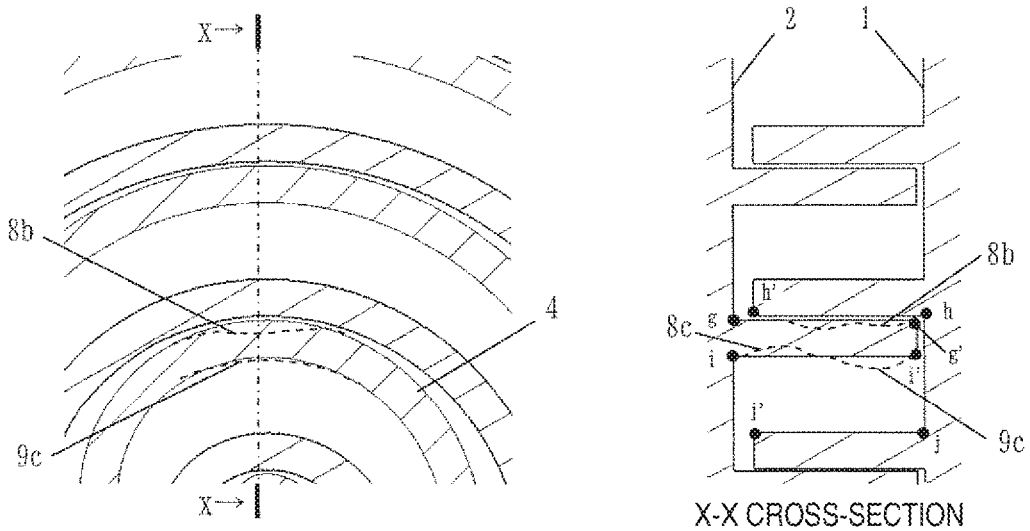
FIG. 12 is a cross-sectional view of a lap part according to Example 4 of the present invention.

Next, Example 4 is described using FIG. 12. In the same way as in Examples 1 and 2, a concave portion 8*b* is provided in the lateral surface of the lap part 4 in a portion where the lap clearance becomes small due to the deformation of the lap. In the same way as in Example 3, the extension of the concave portion 8*b* and the convex portion 9 provided is along a portion in the tooth height direction. Note that the shape is characterized by a curve, not limited to a line. The shape of this curve is determined by the lap clearance between the lap part 4 and the lateral surface h-h' of the opposing lap part 3. Thus, when necessary, the concave portion 8*b* may be provided in the entire portion g-g', not in a portion. Since the lap part 3 and the lap part 4 often deform in the shape of a curve, it is possible to form the most appropriate lap clearance by making the concave portion 8*b* in the shape of a curve. This is the case with the convex portion 9*c*. The size and the shape of the convex portion 9*c* are determined by the lap clearance between the lap part 4 and the portion j-j' of the lateral surface of the opposing lap part 3. Hence, the size and the shape of the concave portion 8*b* along the portion g-g' and the size and the shape of the convex portion 9*c* along the portion i-i' are not always the same. Additionally, if the convex portion 8*b* is formed in the shape of a curve, it is possible to suppress widening of the lap clearance as much as possible.

Moreover, the convex portion 9*c* and the concave portion 8*c* may both be provided along the portion i-i' of the lap part 4 if the lap clearance between i and j' is small and the lap clearance between i' and j is large in the space between the portion i-i' of the lap part 4 and the portion j-j' of the lap part 3. In that case, the most appropriate lap clearance is formed between the portion j-j' of the lap part 3 and the portion i-i' of the lap part 4, making it possible to achieve both reliability and performance improvement. This is the case with the portion g-g' of the lap part 4.

In the present example, for explanation, the shape of each of the concave portions 8*b* and 8*c* and the convex portion 9*c* is a curve shape. Needless to say, the shape may be linear only, giving priority to formability.

Figure 13:
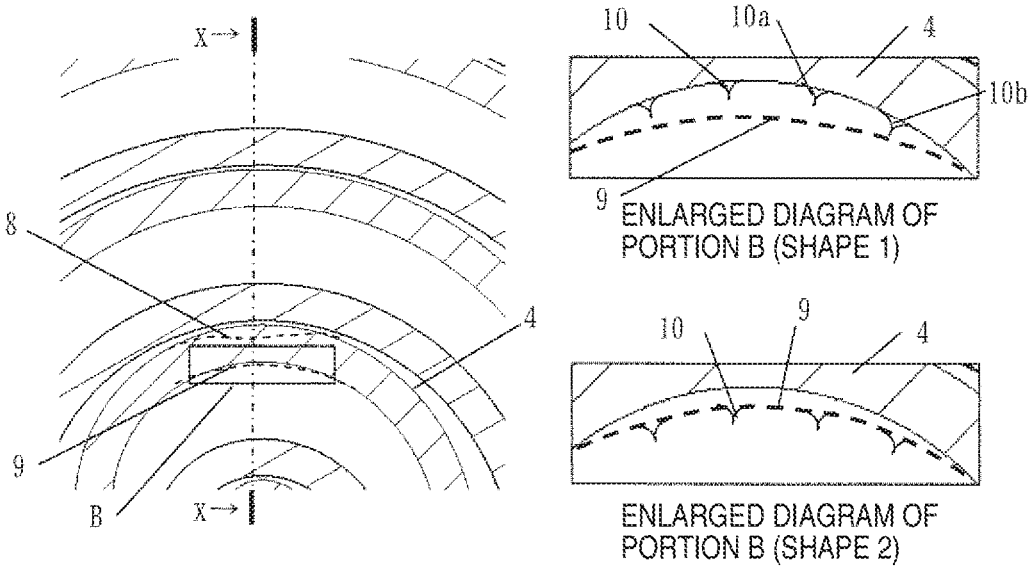
FIG. 13 is a cross-sectional view of a lap part according to Example 5 of the present invention.

Next, Example 5 is described using FIG. 13. FIG. 13 illustrates the shape of the lap part in the present example. Example 5 is characterized in that the concave portion 8 and the convex portion 9 are provided on a lap lateral surface provided with a labyrinth (protrusions 10). As illustrated in FIG. 13, the labyrinth includes the protrusions 10 provided on the lap lateral surface. If the labyrinth is provided, the lap part 3 and the lap part 4 come into contact with each other only at the tip end of each protrusion 10, preventing the entire lap lateral surfaces from coming into contact with each other. Hence, the compressor will not break. Thus, if the labyrinth (protrusions 10) is provided, it is possible to decrease the lap clearance δ and to enhance the efficiency as a compressor. The labyrinth (protrusions 10) is provided so as to prevent the lap part 3 and the lap part 4 from coming into contact with each other on their entire surfaces. For this reason, the range of protrusion from the lap lateral surface is characterized in that it is very small in the circumferential direction.

In the present example, as illustrated in shape 1 of FIG. 13, the convex portion 9 is provided on the lap lateral surface opposite to the lap lateral surface provided with the concave portion 8 in the lap part 4 provided with the labyrinth (protrusions 10). Since the convex portion 9 is intended to prevent widening of the lap clearance δ due to the deformation of the lap part 4, the range of protrusion from the lap lateral surface is characterized in that it is relatively large in the circumferential direction. In addition, in the present example, the lap part 4 deforms in the direction away from the lateral surface of the opposing lap part 3 (direction in which the lap clearance increases) in a region to provide the convex portion 9. Thus, the possibility of coming into contact with the lap part 3 is low. In light of this, the amount of protrusion of the convex portion 9 is larger than the protrusion 10. For this reason, there are no protrusions 10 of the labyrinth in the region where the convex portion 9 is provided. Moreover, since the convex portion 9 is provided at a position higher than the tip end of each protrusion 10, compressed air no longer leaks through between the protrusion 10*a* and the protrusion 10*b*, even more enhancing the efficiency as a compressor. The protrusions 10 are provided in a region where no convex portion is provided.

Alternatively, as in shape 2 of FIG. 13, the protrusions 10 may be provided on the convex portion 9. In that case, although the performance as a compressor decreases, it is possible to prevent breakage even in the case of contact with the lap part 3 in the region where the convex portion 9 is provided. Thus, reliability can be improved.

The foregoing embodiments of Examples 1 to 5 have been described taking as an example the case where a scroll-type fluid machine is used as an air compressor. However, the present invention is not limited to the above but is applicable to other scroll-type fluid machines including e.g. a vacuum pump and a coolant compressor which compresses a coolant.

REFERENCE SIGNS LIST

1 orbiting scroll
2 fixed scroll
3 lap part of orbiting scroll
4 lap part of fixed scroll
5, 5*a*, 5*b*, 5*c*, 5*a*', 5*b*', 5*c*', 5*d*, 5*e*, 5*f*, 5*d*', 5*e*', 5*f* compression chamber
6 suction port
7 discharge port
8, 8*a*, 8*b*, 8*c* concave portion
9, 9*a*, 9*b*, 9*c* convex portion
10, 10*a*, 10*b* protrusion

The invention claimed is:

1. A scroll fluid machine comprising:

a fixed scroll including a spiral-shaped lap part; and an orbiting scroll which is provided facing the fixed scroll and which includes a spiral-shaped lap part, wherein in a portion where a deformation amount of an outer line of a tooth joint side of one of the lap part of the fixed scroll and the lap part of the orbiting scroll is smaller than a deformation amount of an inner line of a tooth tip side of the lap part facing the one lap part, a convex portion is provided in at least one of the outer line of the tooth joint side of the one lap part and the inner line of the tooth tip side of the lap part facing the one lap part, and in a portion where a deformation amount of the outer line of the tooth joint side of the one lap part is larger than a deformation amount of the inner line of the tooth tip side of the lap part facing the one lap part, a concave portion is provided in at least one of the outer line of the tooth joint side of the one lap part and the inner line of the tooth tip side of the lap part facing the one lap part.

2. The scroll fluid machine according to claim 1, wherein the concave portion or the convex portion is formed only in a portion in a height direction of the lap part of the fixed scroll or the orbiting scroll.

3. The scroll fluid machine according to claim 1, wherein the lap part of at least one of the fixed scroll and the orbiting scroll includes a concave portion and a convex portion provided in one lateral surface between a tooth bottom and a tooth tip in a predetermined region.

4. The scroll fluid machine according to claim 1, wherein the convex portion or the concave portion is formed by cutting process of the lap part.

5. The scroll fluid machine according to claim 1, wherein the concave portion or the convex portion has a varying concave amount or convex amount between a tooth bottom and a tooth tip.

6. The scroll-type fluid machine according to claim 1, wherein at least one of the lap part of the fixed scroll and the orbiting scroll includes a plurality of protrusions provided except in a region where the convex portion is provided.

7. The scroll-type fluid machine according to claim 1, wherein at least one of the lap part of the fixed scroll and the orbiting scroll includes a plurality of protrusions provided also in a region where the convex portion is provided.

8. The scroll-type fluid machine according to claim 1, wherein the convex portion and the concave portion are provided in a plurality of regions of at least one of the lap part of the fixed scroll and the orbiting scroll.

9. The scroll fluid machine according to claim 1, wherein the convex portion is formed in different sizes depending on a region and on a deformation amount while in operation of the fixed scroll and the orbiting scroll.

10. A scroll fluid machine comprising:

a fixed scroll including a spiral-shaped lap part; and an orbiting scroll which is provided facing the fixed scroll and which includes a spiral-shaped lap part, wherein in a portion where a deformation amount of an inner line of a tooth joint side of one of the lap portion of the fixed scroll and the lap portion of the orbiting scroll is smaller than a deformation amount of an outer line of a tooth tip side of the lap portion facing the one lap portion, a concave portion is provided in at least one of the inner line of the tooth joint side of the one lap portion and the outer line of the tooth tip side of the lap portion facing the one lap portion, and wherein in a portion where a deformation amount of the inner line of the tooth joint side of the one lap portion is larger than a deformation amount of the outer line of the tooth tip side of the lap portion facing the one lap portion, a convex portion is provided in at least one of the inner line of the tooth joint side of the one lap portion and the outer line of the tooth tip side of the lap portion facing the one lap portion.

* * * * *